US005529460A

United States Patent [19]

Eihusen et al.

[11] Patent Number: 5,529,460

[45] Date of Patent: Jun. 25, 1996

[54] PRESSURE WASHER WITH FLOW CONTROL SWITCH

[75] Inventors: John A. Eihusen; Kenneth M. Frank; Dean L. Tietz; Stephen W. Leutbecher; Bob Crum, all of Kearney, Nebr.

[73] Assignee: Coleman Powermate, Inc., Kearney, Nebr.

[21] Appl. No.: 98,628

[22] Filed: Jul. 28, 1993

[51] Int. Cl.[6] ..... F04B 49/00

[52] U.S. Cl. ..... 417/20; 417/44.2; 417/204; 417/307; 239/124; 239/310

[58] Field of Search ..... 417/20, 44.1, 44.2, 417/44.8, 53, 63, 307, 204; 239/124, 526, 310, 532; 222/341

[56] References Cited

U.S. PATENT DOCUMENTS

| | | | |
|---|---|---|---|
| 2,868,914 | 1/1959 | Gleason | 417/44.8 |
| 3,125,285 | 3/1964 | Larsson . | |
| 3,446,238 | 5/1969 | Norstrud et al. | 417/44.8 |
| 3,623,827 | 11/1971 | McJones | 417/44.1 |
| 3,694,105 | 9/1972 | Martin | 417/44.1 |
| 3,719,435 | 3/1973 | Eheim . | |
| 3,760,982 | 9/1973 | Haase . | |
| 4,061,271 | 12/1977 | Kimbrough . | |
| 4,294,277 | 10/1981 | Szeliga . | |
| 4,313,111 | 1/1982 | Anderson . | |
| 4,365,125 | 12/1982 | Keller . | |
| 4,387,850 | 6/1983 | Gerber . | |
| 4,435,626 | 3/1984 | Coffin . | |
| 4,476,889 | 10/1984 | Haynes | 417/44.8 |
| 4,589,825 | 5/1986 | Schmidt | 417/307 |
| 4,792,113 | 12/1988 | Eidsmore . | |
| 4,879,439 | 11/1989 | Banus Garcia . | |
| 4,926,904 | 5/1990 | Polk . | |
| 4,934,598 | 6/1990 | Schnetzer . | |
| 4,940,207 | 7/1990 | Katsuyama . | |
| 5,055,641 | 10/1991 | Richards . | |
| 5,067,654 | 11/1991 | Paige . | |
| 5,086,975 | 2/1992 | Paige . | |
| 5,126,097 | 6/1992 | Weng . | |
| 5,174,723 | 12/1992 | Groger . | |
| 5,259,556 | 11/1993 | Paige et al. | 239/124 |

FOREIGN PATENT DOCUMENTS

| | | | |
|---|---|---|---|
| 0263196 | 4/1988 | European Pat. Off. . | |
| 0539721A | 5/1993 | European Pat. Off. . | |
| 2746037 | 4/1979 | Germany | 239/124 |
| 3047493A1 | 7/1982 | Germany . | |
| 3311363C1 | 11/1984 | Germany . | |
| 3724386 | 5/1989 | Germany . | |
| 3936155 | 5/1991 | Germany . | |

OTHER PUBLICATIONS

Database WPI Derwent Publications Ltd., London, GB; AN 84–078426 131 & JP–A–59 029 787 (Bautekku Kogyo KK) 77 Feb. 1984 abstract.

*Primary Examiner*—Richard E. Gluck
*Assistant Examiner*—Xuan M. Thai

[57] ABSTRACT

A pressure washer is provided with a flow control switch and a bypass passage. The flow control switch shuts the motor of the pressure washer off when fluid is not being supplied to the pressure washer or when the spray gun of the pressure washer is closed. The bypass passage relieves excess outlet pressure and activates the flow control switch when the spray gun is closed. The pressure washer may include a soap pump for injecting soap into low pressure fluid at the inlet of the pressure washer.

20 Claims, 10 Drawing Sheets

PRESSURE WASHER WITH FLOW CONTROL SWITCH

BACKGROUND AND SUMMARY

This invention relates to pressure washers, and, more particularly, to a pressure washer which is equipped with a flow control switch for shutting off power to the pressure washer if fluid is not flowing through the pressure washer.

Pressure washers are well known devices for delivering water or other washing fluid under high pressure, e.g., about 1200 to 2000 psi. Pressure washers conventionally include a pump assembly which includes a plurality of pumping pistons which are driven by an electric motor or an internal combustion motor. Fluid is commonly supplied to the pump by a garden hose. Pressure washers of this type are described in U.S. Pat. Nos. 5,068,975, 5,067,654, and 5,174,723.

Conventional electric pressure washers utilize a main power switch which requires the operator of the pressure washer to physically move the switch from one position (off) to another position (on) to supply electrical power to the electric motor of the pressure washer. If the power cord is plugged into an electric outlet, the electric motor will start and will continue to run until the switch is physically moved to the off position.

If the electric motor is started without water or other washing fluid being supplied to the pressure washer, the pump might overheat and fail without the cooling and lubrication which the water provides. Electrical and mechanical safety hazards could also result from that type of operation.

If the flow of water is stopped after the pressure washer is turned on, for example, if a kink develops in the garden hose which supplies the water or if another person turns off the water faucet, similar difficulties could arise if the motor was not turned off and the pump continued to run.

Many current pressure washers include a by-pass valve and a by-pass passage which activates when the high pressure gun is deactivated. Since the electric motor and pump continue to run, it is necessary to recirculate the water in a by-pass mode to cool the pump. Many units have a time limit of around five minutes during which the unit may be operated in the by-pass mode. If this time limit is exceeded, damage to the pump can result.

SUMMARY OF THE INVENTION

The invention provides a flow control switch for a pressure washer which prevents the pressure washer from being turned on if water is not being supplied to the pressure washer and which automatically turns the pressure washer off if the flow of water through the pressure washer stops. The invention thereby prevents premature failure of the pressure washer because of the pump running without water. Since the motor will shut off when water flow through the pump stops, the motor on/off function can be remotely controlled by opening and closing the high pressure gun. This feature has several advantages. If something were to happen which would require the operator of the pressure washer to turn the unit off, he could do so much more quickly by closing the high pressure gun rather than going to the unit itself and turning off the main power switch as is required in current products. Since the motor and pump are turned off when the high pressure gun is closed, the problem of running the unit in the by-pass mode for an excessive period of time is eliminated. If a kink develops in the supply hose or if the main water supply is turned off, the motor and pump are automatically stopped. Another possible difficulty with current products which is overcome by the invention occurs if the main power switch on the pressure washer is left in the on position and the power cord is plugged into an electrical outlet. Prior devices would start and stay running without the operator being physically present at the unit. However, in the inventive pressure washer the flow control switch would turn the motor off because the high pressure gun was closed.

The flow control switch advantageously utilizes a pair of magnetic pistons which are aligned like-pole-to-like-pole so that the pistons magnetically repel each other. A first piston is mounted in a switch passage within the pump housing which communicates with the water inlet. The second piston is mounted on the outside of the pump housing and is engageable with a spring-biased pushbutton of an electrical switch. If water is not being supplied to the inlet, the first piston is repelled by the second piston, and the spring-biased switch remains open. If water is supplied to the inlet, the pressure of the water forces the first piston toward the second piston, and the second piston is repelled to overcome the spring force of the switch and to close the switch.

A by-pass passage extends from the outlet to the inlet and is normally closed by a two-stage poppet valve. A small-diameter first stage of the poppet engages a valve seat in the by-pass passage. When the high pressure gun is closed, a surge of high pressure at the outlet opens the poppet valve. The by-pass passage communicates with the switch passage and the high pressure in the by-pass passage forces the first magnetic piston away from the second piston to open the switch.

A soap injection pump injects soap into the low pressure inlet side of the pump. The soap flows through the pump with the water and is ejected from the high pressure gun at high pressure.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
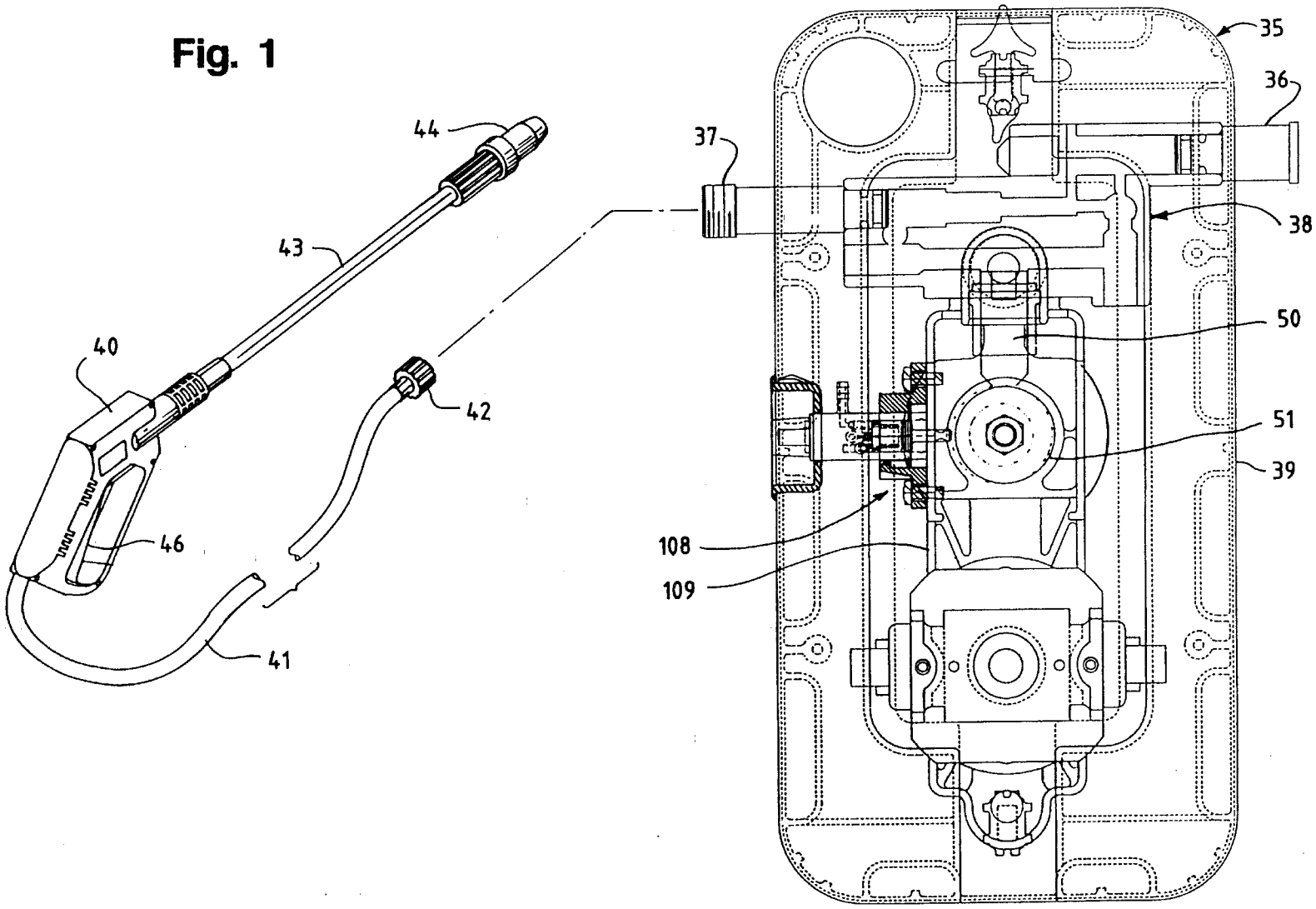
FIG. 1 is a fragmentary sectional view of a pressure washer formed in accordance with the invention.

Referring first to FIG. 1, the numeral 35 designates generally a pressure washer which includes a fluid inlet fitting 36, a fluid outlet fitting 37, and a pump assembly 38 which is enclosed by an outer case 39. A conventional high pressure spray gun 40 can be connected to the male threads of the fluid outlet 37 by a hose 41 having a female coupling 42. The high pressure gun 40 includes a spray wand 43, an nozzle 44, and a spring-biased trigger 46 for opening a valve in the spray gun. When the trigger is not depressed, the spray gun remains closed.

Figure 2:
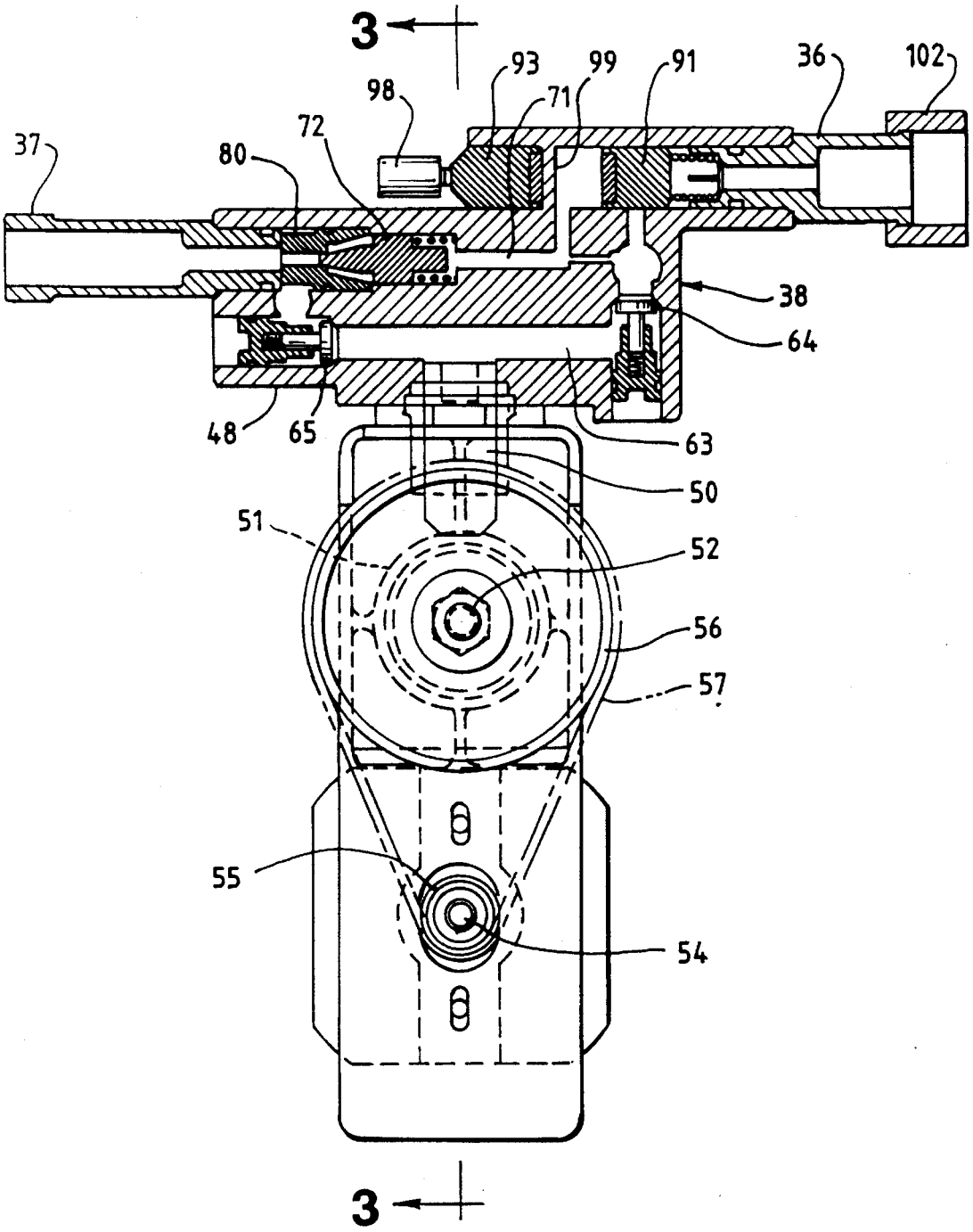
FIG. 2 is a fragmentary sectional view showing the details of the pump assembly.
Figure 3:
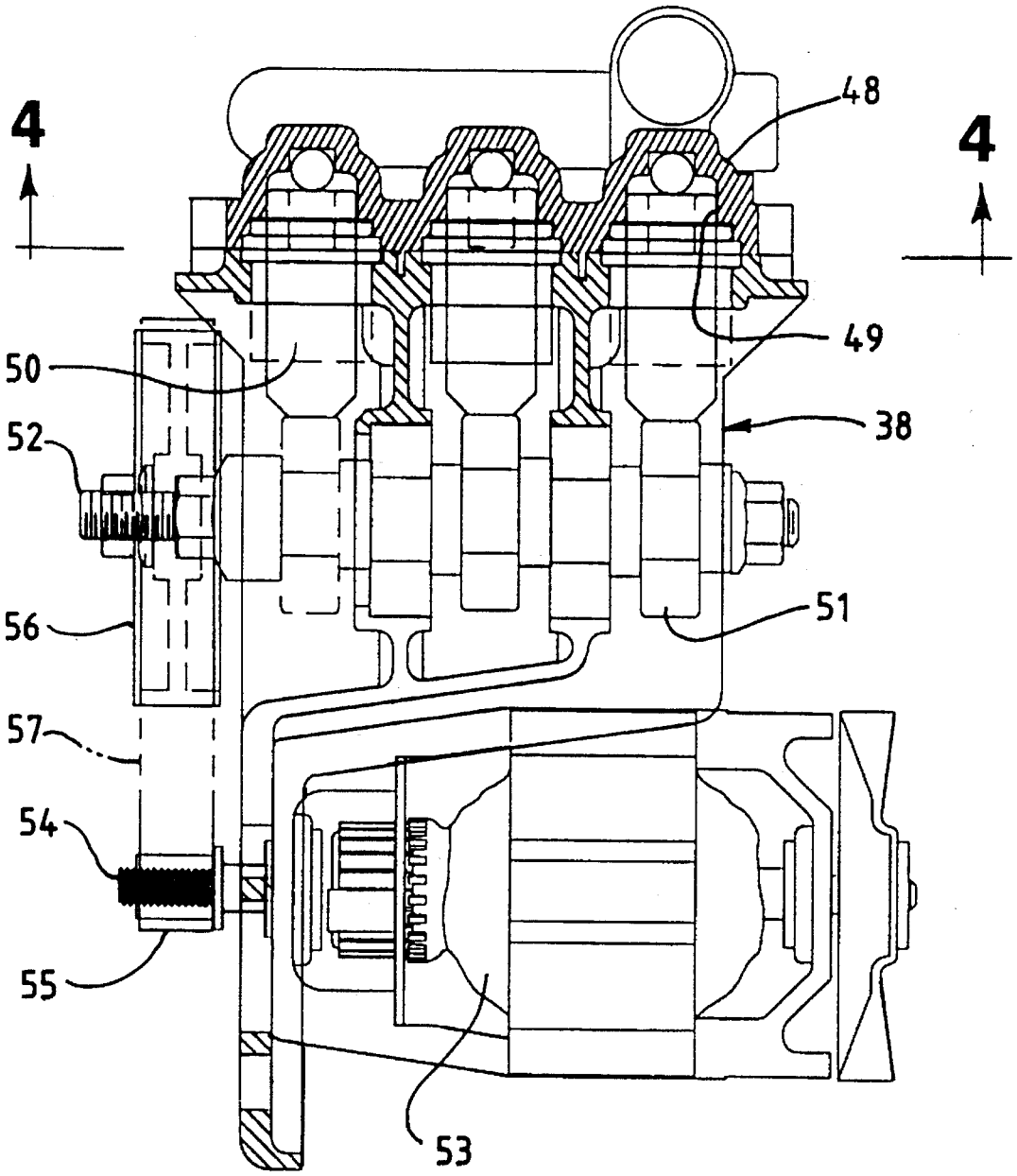
FIG. 3 is a sectional view taken along the line 3—3 of FIG. 2.
Figure 4:
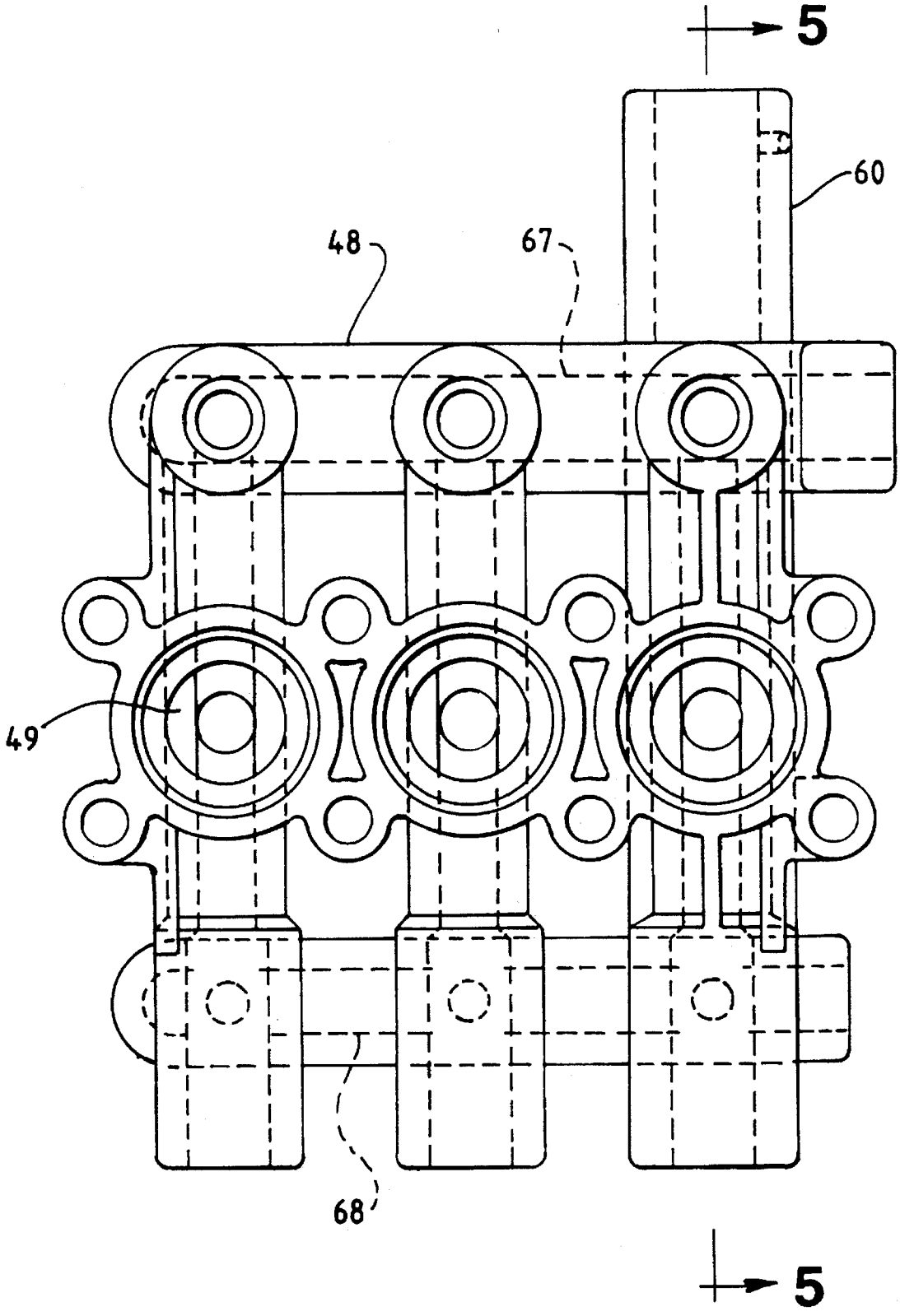
FIG. 4 is a bottom plan view of the pump housing as would be seen along the line 4—4 of FIG. 3.

Referring to FIGS. 2–4, the pump assembly 38 includes a pump housing 48 which is provided with three pump cylinders 49, and three spring-biased pumping pistons 50. Each of the pistons is reciprocated by a cam 51, and the cams are rotated by a cam shaft 52. The cam shaft 52 is driven by an electric motor 53 having a rotary drive shaft 54. The shafts 52 and 54 are connected by small and large pulleys 55 and 56 and a drive belt 57.

Figure 5:
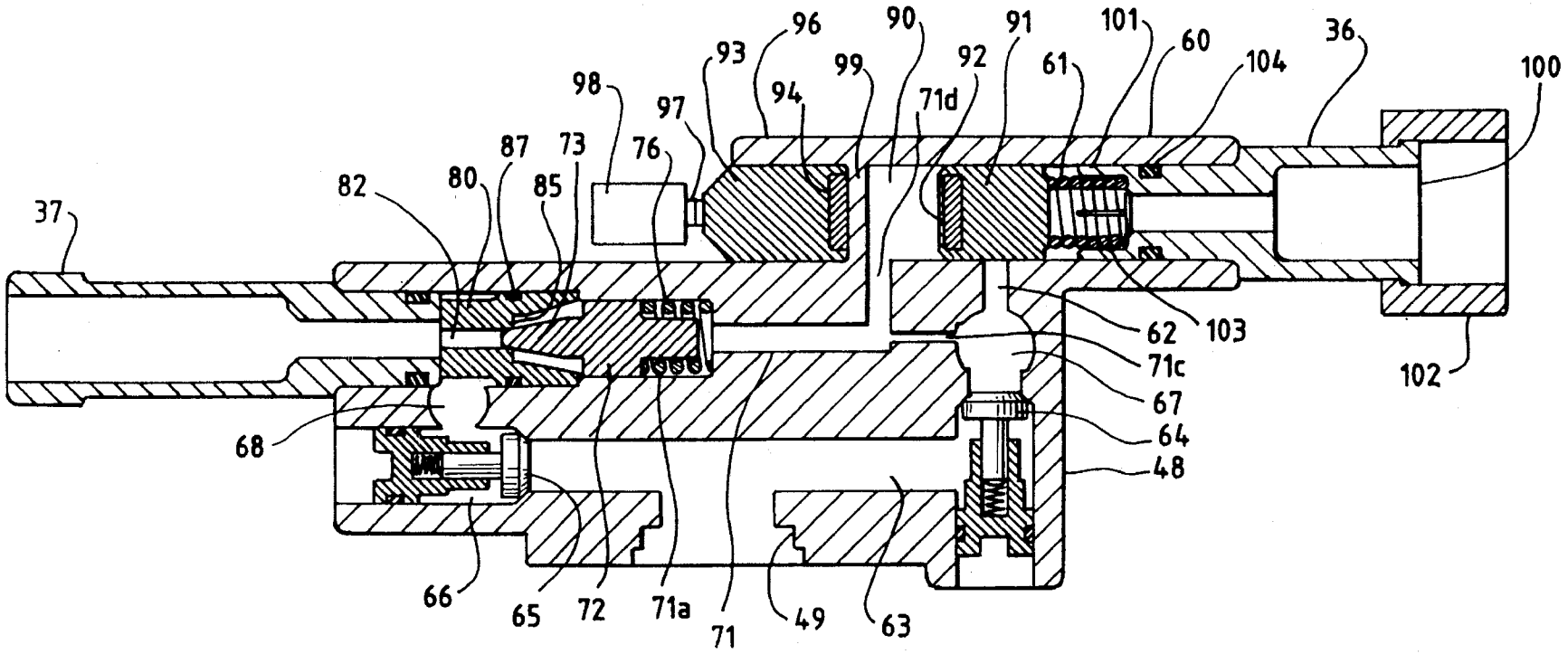
FIG. 5 is an enlarged sectional view of the pump assembly of FIG. 2.

FIG. 5 is a sectional view of the pump assembly as would be seen along the line 5—5 of FIG. 4. The pump housing includes an inlet tube 60 into which the inlet fitting 36 is inserted. The inlet tube 60 provides a first inlet passage 61, and a second inlet passage 62 extends downwardly from the inlet tube 60 to a pumping chamber 63. One end of the pump passage 63 is closed by a spring-biased inlet check valve 64, and the other end of the pump chamber is closed by a spring-biased outlet check valve 65. An outlet passage 66 extends from the outlet check valve 65 and communicates with the outlet passage of the outlet fitting 37.

The inlet passage 62 is connected to the inlet openings of the three pump chambers 63 by a cross passage 67, and the outlet openings of the pump chambers are connected by a cross passage 68 so that the three pumping pistons pump in series to pump fluid from the inlet to the outlet.

Figure 13:
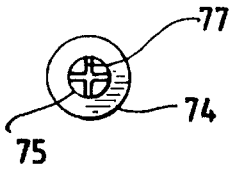
FIG. 13 is a rear end view of the poppet valve of FIG. 11.
Figure 11:
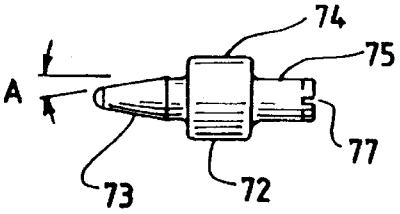
FIG. 11 is a side elevational view of the by-pass poppet valve.
Figure 12:
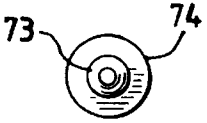
FIG. 12 is a front end view of the poppet valve of FIG. 11.

A by-pass passage 71 extends from the outlet passage 66 to the inlet passage 62 and is normally closed by a by-pass valve 72. Referring to FIGS. 11–13, the by-pass valve 72 is a two-stage poppet valve which includes a conically-shaped small-diameter first stage 73 and a cylindrical large-diameter second stage 74. A cylindrical projection 75 extends from the second stage 74 and centers a compression spring 76 (FIG. 5). The rear end of the cylindrical projection 75 is provided with a cruciform groove 77.

Figure 15:
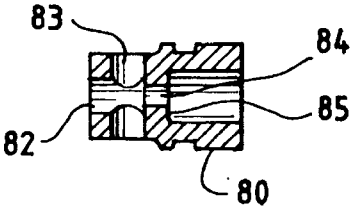
FIG. 15 is a sectional view of the by-pass valve taken along the line 15—15 of FIG. 14.
Figure 14:
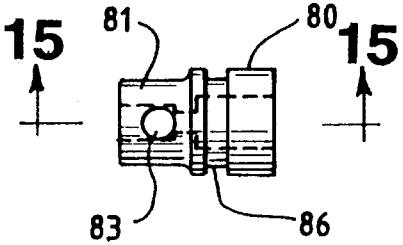
FIG. 14 is a top elevational view of the by-pass valve seat.
Figure 7:
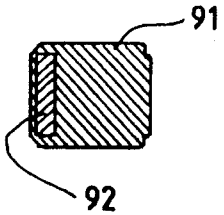
FIG. 7 is a sectional view of one of the inside pistons of the flow control switch.
Figure 8:
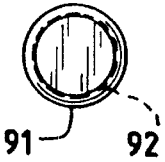
FIG. 8 is an end view of the piston of FIG. 7.
Figure 10:
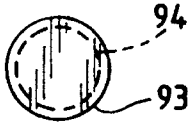
FIG. 10 is an end view of the magnetic piston of FIG. 9.
Figure 9:
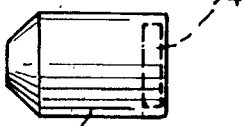
FIG. 9 is a sectional view of the outside magnetic piston of the flow control switch.
Figure 16:
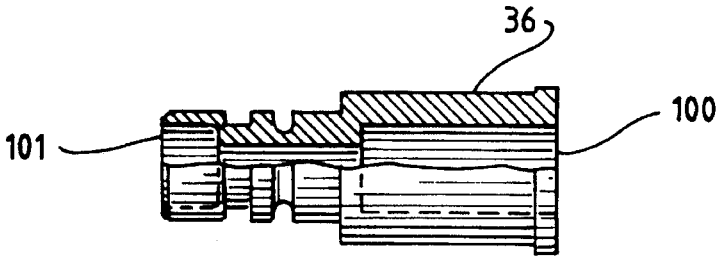
FIG. 16 is a side elevational view, partially broken away, of the low pressure fitting.

Referring to FIGS. 14 and 15, the by-pass valve 72 seats in a valve seat 80 which is positioned within the by-pass passage of the pump housing. The valve seat includes a cylindrical inlet portion 81 which is provided with a longitudinal bore 82 and a cross bore 83. A reduced-diameter orifice 84 is provided through an annular valve seat 85. An annular groove 86 is provided on the outer surface of the valve seat for receiving a sealing gasket 87 (FIG. 5).

Referring to FIG. 5, the conical end of the by-pass poppet valve 72 is normally maintained in engagement with the valve seat 85 by the spring 76. Pressurized fluid which is pumped out of the pumping chamber 63 flows through the cross bore 83 of the valve seat, through the longitudinal bore 82, and into the outlet fitting 37.

Still referring to FIG. 5, the by-pass passage 71 includes a portion 71*a* in which the valve 72 is slidably positioned, a portion 71*b* behind the valve, and a small-diameter portion 71*c* which connects with the inlet passage 62. A switch-actuating passage 71*d* connects passage 71*b* to a switch passage 90 which is provided by the inlet tube 60.

A first piston or shuttle 91 is slidably positioned in the switch passage 90. The piston 91 carries a magnetic disc 92. The piston can advantageously be formed by injection molding non-ferrous material, for example Delrin plastic, around the magnet. A second piston or shuttle 93 is slidably mounted outside of the pump housing in a cylindrical bore which is provided within a cylindrical wall 96 on the pump housing. The piston 93 also encapsulates a magnet 94. The second magnetic piston 93 is engageable with a spring-biased push button 97 of a conventional electrical microswitch 98. Such microswitches are well known. When the push button is not depressed, the contacts of the switch are open. When the push button is depressed, the contacts are closed. The microswitch is connected in series with a main power switch to provide power to the electric motor 53.

Referring to FIG. 5, the low pressure fitting 36 includes an outer end 100 and an inner end 101. An internally threaded female hose coupler 102 is rotatably mounted on the outer end, and a coil spring 103 is positioned a cylindrical bore in the inner end. A gasket 104 is positioned in an annular groove and provides a seal with the inlet tube 60.

Operation

A source of water or other washing fluid is connected to the pressure washer by the inlet fitting 36. Ordinarily, a garden hose is connected to the inlet fitting by the hose coupler 102. Before the water supply is turned on, the flow control switch which is provided by the magnetic pistons 91 and 93 and the electric switch 98 is positioned as illustrated in FIG. 5. The magnets 92 and 94 have common poles facing each other, and the internal spring of the spring-actuated push button 97 forces the piston against the wall 99 of the pump housing. The magnet 92 and piston 91 are magnetically repelled to the right away from the magnet 94. The pump housing is made of non-ferrous material, for example, BASF Ultraform N2320.

Figure 6:
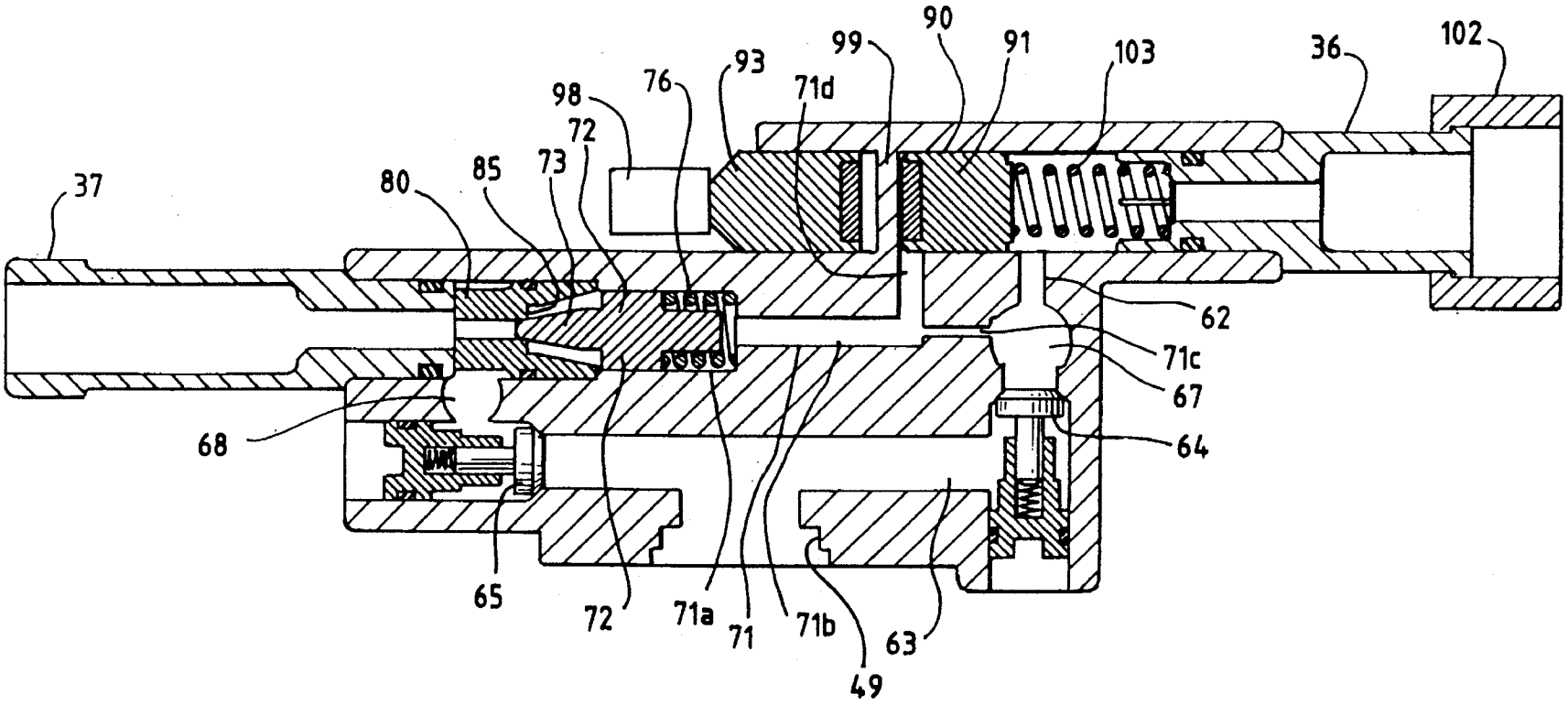
FIG. 6 is a view similar to FIG. 5 with the flow control switch in the on position.

When the water supply is turned on, the pressure of the water which flows through the inlet fitting forces the piston 91 to the left, as illustrated in FIG. 6. The piston 93 is magnetically repelled to the left and pushes the push button 97 to close the contacts of the switch 98. When the piston 91 moves to the left, the inlet passage 62 is opened, and water flows through the cross passage 67 to the inlet check valve 64 of each of the pumping chambers 63.

When the switch 98 closes, and if the main power switch is turned on, electric power is supplied to the electric motor 53 (FIG. 3), and the motor rotates the cam shaft 52. The pumping pistons 50 are reciprocated by the rotating cams 51. As each pumping piston moves away from its pumping chamber 63, water is drawn into the pumping chamber past the inlet check valve 64. When the piston moves toward the pumping chamber, the inlet check valve closes, and water is pumped out of the pumping chamber past the outlet check valve 65. Water which is pumped from each of the pumping chambers flows through the cross passage 68, through the valve seat 80, and to the outlet fitting 37. If the valve of the high pressure gun 40 is closed by depressing the trigger 46, high pressure fluid is pumped through the pressure gun and is sprayed by the nozzle 44.

When the valve in the high pressure gun is held open by the trigger 46, the pressure in the bore 82 of the by-pass valve seat 80 is not sufficient to overcome the force of valve spring 76 to unseat the small-diameter conical end 73 of the by-pass valve 72 from the valve seat 85. However, when the trigger 46 is released and the valve of the pressure gun closes, a high pressure spike of fluid pressure hits the conical end 73 of the by-pass valve and unseats the by-pass valve from the valve seat 85. Once the conical end 73 is unseated from the valve seat, high pressure fluid will contact the large-diameter second stage 74 (FIG. 11) of the by-pass valve. Since the surface area of the valve which is contacted by fluid when the valve is open is substantially greater than the surface of the conical end of the valve which is contacted by fluid when the valve is closed, the valve will be maintained open at a significantly lower pressure than is required to unseat the valve from the valve seat.

When the by-pass valve 72 opens, high pressure fluid flows past the second stage of the valve through the annular clearance between the second stage of the valve and the inside surface of the by-pass passage 71*a*. The high pressure fluid flows through the by-pass passage 71*a* and into the passages 71*b*, 71*c*, and 71*d*. The diameter of the portion 71*c* of the by-pass passage is significantly less than the diameter of the portions 71*b* and 71*d*, and high pressure fluid will contact the left face of magnetic piston 91 (FIG. 6) and force the magnetic piston 91 away from the second magnetic piston 93. The piston 93 is thereby allowed to be forced against the wall 99 of the housing by the spring-biased push button of the switch 98, and the contacts of the switch 98 are opened. Power to the electric motor 53 is thereby turned off, and the pistons 50 stop pumping.

Although only a brief period of time elapses between the time when the high pressure gun is turned off and the time when electric power to the motor is shut off, the pump might continue to operate for a short period of time because of inertia. Excess pressure within the pump assembly is relieved by the small-diameter by-pass passage 71*c*, which allows high pressure fluid to flow into the cross passage 67, where it can be recirculated through the pumping chambers 63.

When the pressure gun 40 is closed and the pump assembly is in the by-pass mode, the pressure of the fluid in the by-pass passage is higher than the pressure of the fluid at the inlet fitting 36. The magnetic piston 91 is thereby maintained in the position illustrated in FIG. 5 in which the electric switch 98 is closed and the inlet passage 62 is blocked by the piston 91. The coil spring 103 ensures that the pressure within the pump assembly will be maintained higher than the supply pressure of the fluid at the inlet while the high pressure gun is closed. Without the coil spring 103, it would be much easier to experience a condition in which the pressure within the pump assembly drops below the supply pressure. In that event, the system becomes unstable, and the flow control switch would oscillate or hunt for the off condition, i.e., the magnetic piston 91 would oscillate back and forth from an on position to an off position.

Referring to FIG. 11, the angle A of the conical surface of the first stage 73 of the by-pass valve 74 controls how fast the by-pass valve opens for a given deflection of the spring 76. If the angle is too steep, i.e., the conical end is more pointed, not enough flow is able to pass between valve 73 and seat 80 to activate the magnetic piston 91 and the flow control switch does not function. If the angle is too shallow, i.e., the conical end is more blunt, the flow control system becomes unstable and bounces or hunts for the off condition.

The annular space between the large-diameter second stage 74 of the by-pass valve and the wall of the by-pass passage 71*a* in which the valve reciprocates provides a secondary orifice of the by-pass valve and controls the flow of fluid past the second stage of the valve. If the space is too small, the by-pass pressure upstream of the valve will be too high, and the by-pass pressure downstream of the valve will be too small to operate the flow control switch. If the space is too large, by-pass fluid will flow past the second stage too fast and will not provide sufficient force on the second stage to maintain the valve open. The ratio of the orifice 84 of the valve seat 85 to the diameter of the second stage 74 of the by-pass valve is a major control variable in tuning the flow control switch.

In one specific embodiment of the invention, the angle A of the conical end of the by-pass valve was 10°, and the diameter of the orifice through the valve seat 85 was 0.125 inch. The diameter of the second stage 74 of the by-pass valve was 0.495 inch, and the inside diameter of the by-pass passage 71*a* in which the valve reciprocated was 0.500 inch, leaving a clearance of 0.005 inch.

The diameter of the small-diameter portion 71*c* of the by-pass passage controls the bleed rate of the pump, directs the high pressure fluid to the left end of the magnet piston 91, and provides a snap off of the flow control switch when the pressure gun is shut off. If the diameter of the passage 71*c* is too large, the flow control switch loses speed of operation. If the diameter of the passage 71*c* is too small, the by-pass pressure goes to unacceptably high pressures.

In one specific embodiment of the by-pass passage, the diameter of the portion 71*b* of the passage was 0.150 inch, the diameter of the portion 71*c* of the passage was 0.065 inch, and the diameter of the branch 71*d* was 0.203 inch. The inside diameter of the inlet tube 60 which defines the switch passage 90 was 0.625 inch. The outside diameter of the magnet piston 91 was 0.620 inch.

If the fluid supply is turned on while the pressure gun is closed, the pressure of the incoming fluid will initially move the magnet piston 91 to the left as illustrated in FIG. 6, close the switch 98, and begin operation of the electric motor 53 and pumping pistons 50. However, the fluid pressure at the outlet will immediately increase sufficiently to open the by-pass valve 72, thereby forcing the flow control switch open to shut off power to the motor.

If the supply of fluid to the pressure washer is discontinued, for example, by a kink in the supply hose or by turning the source of fluid off, the fluid pressure which acts on the magnet piston 91 will drop sufficiently to permit the magnet piston 91 to be repelled to the right in FIGS. 5 and 6 thereby permitting the magnet piston 93 to be forced to the right by the push button 97 and opening the switch 98. Power to the electric motor is thereby shut off and the pump is protected from failure which could be caused by running without fluid.

Soap Dispenser

The pressure washer is advantageously equipped with a soap injection pump which dispenses soap into the fluid at the low pressure inlet side of the pump assembly so that the soap flows through the pump and is forced out of the high pressure gun at high pressure. Heretofore, soap injection in pressure washers was generally accomplished by using a venturi on the high pressure side of the pump. Operation of the venturi requires a two-stage nozzle for the high pressure gun. A large-diameter opening for the nozzle is required to create a high mass flow of water in order to activate the venturi to aspirate soap into the fluid which flows through the venturi. However, the increased flow of fluid is obtained at the expense of outlet pressure. If the nozzle is operated at a small diameter in order to provide high pressure washing, the venturi will not aspirate soap.

Figure 17:
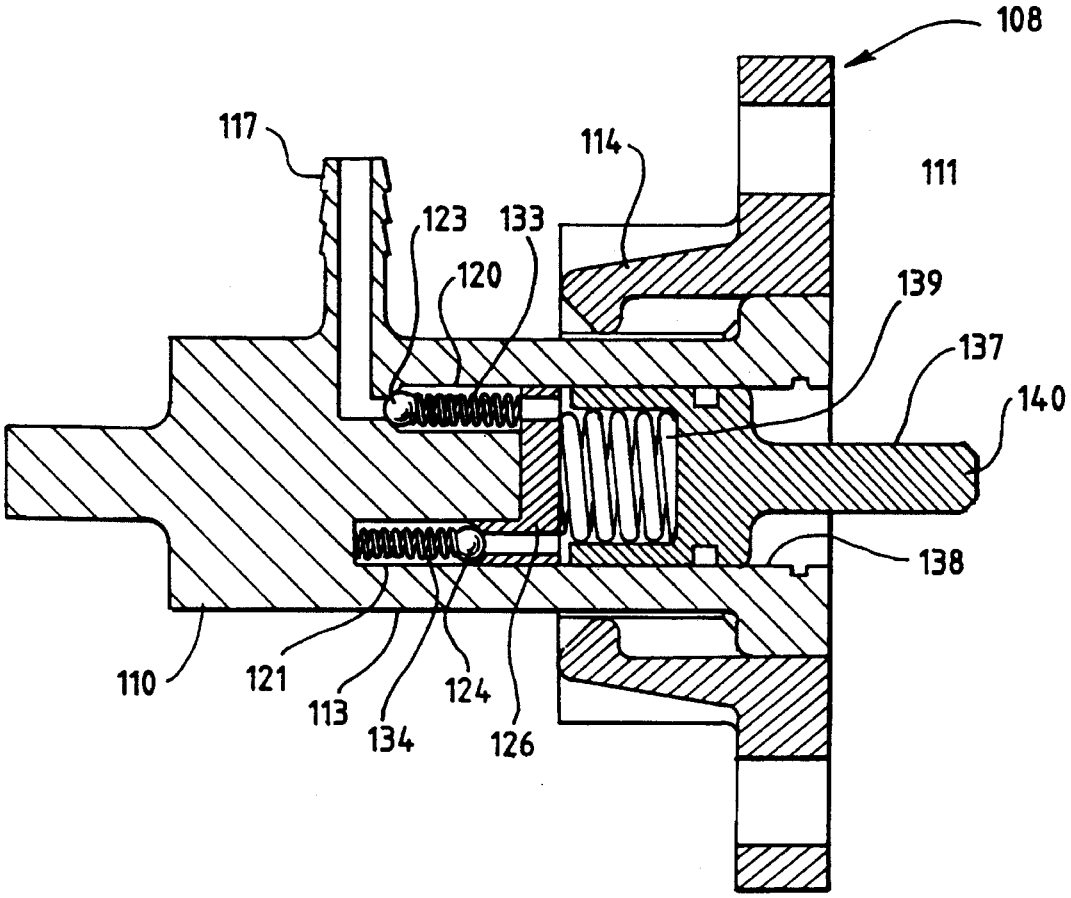
FIG. 17 is a sectional view of the soap injection pump.
Figure 26:
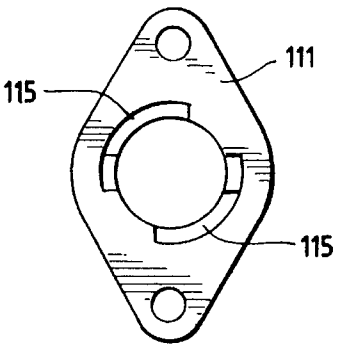
FIG. 26 is a bottom plan view of the mounting bracket of the soap pump assembly.
Figure 25:
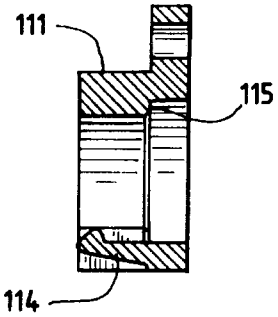
FIG. 25 is a sectional view of the mounting bracket taken along the line 25—25 of FIG. 24.
Figure 24:
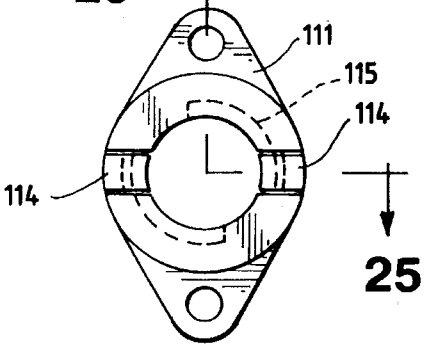
FIG. 24 is an end view of the mounting bracket for the soap injection pump.

Referring to FIGS. 1 and 17, a soap pump assembly 108 is bolted to the frame 109 which supports the electric motor, cam shaft, and fluid pump assembly. The soap pump assembly includes a pump body 110 which is supported within a mounting bracket 111 which is bolted to the frame 109. The pump body 110 includes a cylindrical side wall 112 and a pair of radially outwardly extending mounting flanges 113 (see also FIG. 19). The pump body is inserted into the mounting bracket by pushing the flanges 113 past a pair of flexible and resilient retaining fingers 114 on the mounting flange until the projections are positioned in a pair of curved undercut grooves 115 (FIGS. 24–26) in the mounting bracket. The pump body is then rotated to lock the projections 113 within the undercut grooves.

Figure 20:
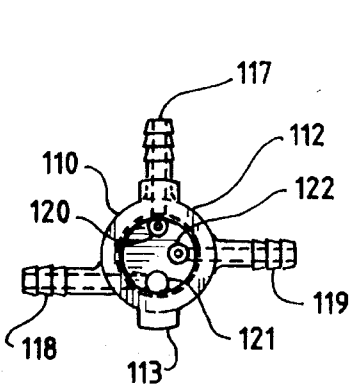
FIG. 20 is an end view of the body of the soap injection pump taken along the line 20—20 of FIG. 18.
Figure 18:
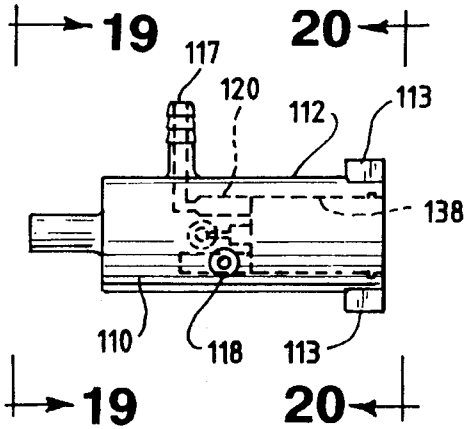
FIG. 18 is a side elevational view of the body of the soap injection pump.
Figure 19:
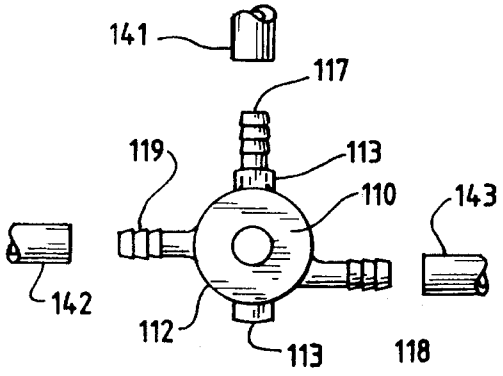
FIG. 19 is an end view of the body of the soap injection pump taken along the line 19—19 of FIG. 18.

Referring to FIGS. 19–20, the pump body 110 includes three barbed tube fittings 117, 118, and 119. The fitting 117 communicates with an inlet passage 120 in the pump body, the fitting 118 communicates with an outlet passage 121, and the fitting 119 communicates with a bleed passage 122.

Figure 23:
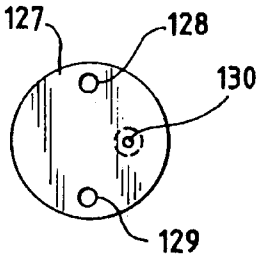
FIG. 23 is an end view of the check seat taken along the line 23—23 of FIG. 21.
Figure 21:
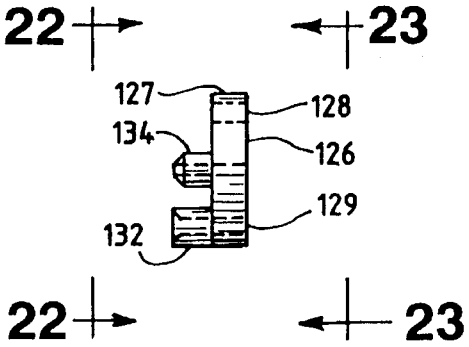
FIG. 21 is a side elevational view of the check seat of the soap injection pump.
Figure 22:
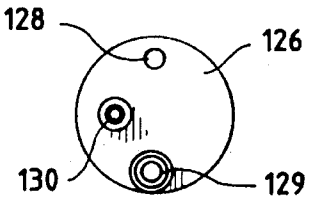
FIG. 22 is an end view of the check seat taken along the line 22—22 of FIG. 21.

Referring to FIG. 17, an inlet ball check valve 123 and an outlet ball check valve 124 are retained within the inlet and outlet passages by a check seat 126 (see also FIGS. 21–23). The check seat 126 includes a cylindrical disk 127 which is provided with an inlet opening 128, an outlet opening 129, and a bleed opening 130. The bleed opening 130 extends through a locating pin 131 which is positioned within the bleed passage 122 of the pump body. A cylindrical valve seat 132 extends from the check seat around the outlet opening 129. The inlet ball valve 123 is biased against a valve seat provided in the pump body by a spring 133 (FIG. 17), and the outlet ball valve 124 is resiliently biased against the valve seat 132 by a spring 134.

A soap piston 137 is positioned within a cylindrical bore 138 of the pump body and is resiliently biased away from the check seat by a spring 139. The soap piston includes a rod-shaped projection 140 which extends beyond the mounting bracket 111 and which engages one of the cams 51 (see FIG. 1) which reciprocates a pumping piston 50. The soap piston 137 is thereby reciprocated within the pump body as the cam rotates.

A plastic tube 141 (FIG. 19) is connected to the inlet fitting 117 and extends into a container of soap, which can be located outside of the pressure washer. Another plastic tube 142 can be connected to the bleed fitting 119 and inserted into the soap container. A third plastic tube 143 is connected to the outlet fitting 118 and is connected to a fitting (not shown) which communicates with the inlet passage 62 (FIG. 5) of the pump housing. As the soap piston 137 reciprocates, soap is drawn into the bore 138 of the pump body through the inlet fitting 117 and the inlet valve 123 and is pumped out of the pump body past the outlet valve 124 and through the outlet fitting 118.

The bleed opening 122 is provided in the pump body primarily for priming the pump and for eliminating air bubbles within the pump. Once the pump is primed and air is eliminated, very little soap travels through the bleed opening 122 and the bleed fitting 119 because the diameter of the bleed opening is substantially smaller than the diameters of the inlet and outlet passages.

Since the soap is injected into the fluid pump assembly at the low pressure inlet side, the soap flows through the fluid pump with the fluid and is pumped through the outlet passage of the fluid pump under high pressure, for example, of the order of 1200 to 2000 psi. Soap can therefore be pumped through the high pressure gun 40 while the nozzle is in the high pressure setting.

Alternate Embodiment

FIGS. 27–30 illustrate an alternate embodiment of a flow control switch. A switch body 145 is mounted on the pump housing. The switch body includes a relatively large diameter inlet passage 146 and an outlet passage 147 which communicates with the inlet passage 146 through a restricted passage or orifice 148. An L-shaped branch passage 149 connects the outlet passage 147 to the left end of the inlet passage 146.

A piston 150 is slidably mounted in the left end of the inlet passage 146 and carries a magnet 151. A magnet 152 is positioned in a recess in the outside of the switch body and engages a pushbutton 153 of an electrical microswitch 154. An annular sleeve 155 is secured within the inlet passage 146 to the right of the restricted orifice 148 and provides a stop for the piston 150.

Figure 29:
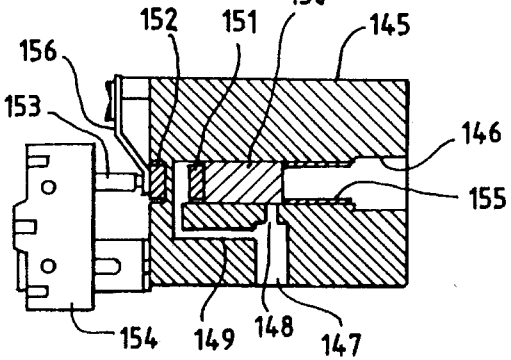
FIG. 29 is a sectional view similar to FIG. 27 showing the flow control switch locked in an off position.
Figure 30:
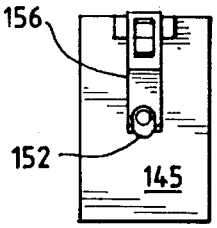
FIG. 30 is a side view of the flow control switch of FIG. 29 without the electrical switch.

The inlet fitting 36 (see FIG. 5) which is adapted to be connected to the fluid supply hose is connected to the inlet passage 146, and the outlet passage 147 is connected to the inlet passage 62 (see FIG. 5) of the fluid pump housing. When no fluid is being supplied by the fluid source, fluid pressure is equalized within the switch body, and the passages 146, 147, and 149 are at the same fluid pressure. The magnet 151 on the piston 150 is repulsed by the magnet 152 and bears against the stop 155 as shown in FIG. 29. The spring-actuated push button 153 of the switch forces the magnet 152 against the switch body, and the contacts in the switch are open.

Figure 27:
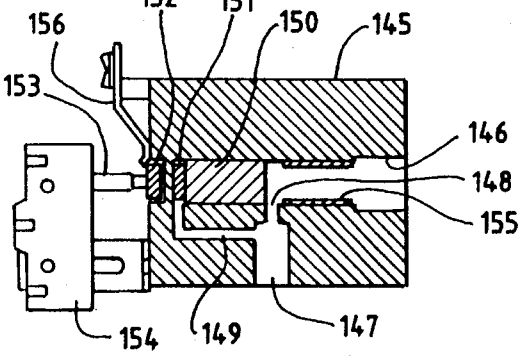
FIG. 27 is a sectional view showing an alternate embodiment of a flow control switch.
Figure 28:
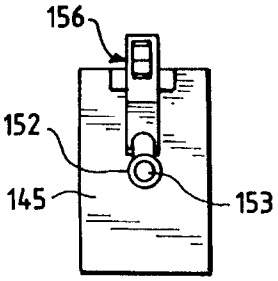
FIG. 28 is a side view of the flow control switch of FIG. 27 without the electrical switch.

When fluid flows into the inlet passage 146, the pressure in passage 146 is greater than the pressure in passages 147 and 149, and the piston 150 is forced to the left as illustrated in FIG. 27. The magnet 152 is repulsed and forces the pushbutton 153 to the left to close the contacts of the switch and provide power to the electric motor. As the piston 150 moves to the left, the orifice 148 is opened, and fluid is allowed to flow through the orifice 148 and the outlet passage 147. The restricted orifice 148 provides a pressure differential between the passages 146 and 147 so that the fluid pressure in the outlet passage 147 is lower than the fluid pressure in the inlet passage 146, and the piston 150 is maintained in the position illustrated in FIG. 27.

When fluid flow through the switch body stops, the pressures in the passages 146, 147, and 149 equalize, and the magnet 151 and the piston 150 are repelled by the magnet 152, which is forced to the right under the spring force of the push button 153 so that the switch contacts open.

If desired, the flow switch of FIGS. 27–30 can be provided with a slide mechanism 156 which can maintain the contacts of the microswitch 154 closed regardless of the flow conditions through the switch body 145. When the slide is in the position illustrated in FIGS. 27 and 28, the slide does not affect operation of the flow control switch. However, when the slide is moved to the position illustrated in FIGS. 29 and 30, the slide will retain the magnet 152 against the switch body 145 and prevent the magnet 152 from moving to the left to depress the push button 153 of the microswitch. The microswitch will thereby be retained in an open position regardless of fluid flow through the fluid control switch, and the pump will not operate. The end of the switch is bifurcated and engages the magnet 152 without engaging the push button 153.

While in the foregoing specification a detailed description of specific embodiments of the invention were set forth for the purpose of illustration, it will be understood that many of the details herein given may be varied considerably by those skilled in the art without departing from the spirit and scope of the invention.

We claim:

1. A pressure washer comprising;

a fluid pump housing having an inlet and an outlet, a pumping piston movably mounted in the housing for pumping fluid from the inlet to the outlet, a motor for driving the pumping piston, a nozzle connected to the outlet and including a valve for opening and closing the nozzle, a flow switch on the pump housing which automatically shuts off the motor when fluid is not flowing into the inlet, and means for relieving excess outlet pressure when the nozzle is closed, said pressure relieving means including a bypass passage in the pump housing extending from the outlet to the inlet, and valve means in the bypass passage for closing the bypass passage until the fluid pressure at the outlet exceeds a predetermined value, the pump housing being provided with a switch-actuating passage which extends from the bypass passage to the flow switch whereby fluid flowing through the bypass passage flows into the switch-actuating passage and opens the flow switch, thereby shutting off the motor.

2. The pressure washer of claim 1 in which the bypass passage includes a small diameter portion between the switch-actuating passage and the inlet which has a diameter smaller than the diameter of the switch-actuating passage.

3. A pressure washer comprising;

a fluid pump hosing having an inlet and an outlet, a pumping piston movably mounted in the housing for pumping fluid from the inlet to the outlet, a motor for driving the pumping piston, a nozzle connected to the outlet and including a valve for opening and closing the nozzle, a flow switch on the pump housing which automatically shuts off the motor when fluid is not flowing into the inlet, and means for relieving excess outlet pressure when the nozzle is closed, the pump housing including a switch passage which communicates with the inlet, and the flow switch including a first magnet movably mounted in the switch passage, a second magnet movably mounted on the pump housing outside of the switch passage, and an electrical switch mounted adjacent the second magnet and having a contact element which is engageable by the second magnet to close the electrical switch and is disengageable from the second magnet to open the switch, the electrical switch being connected to the pump which is turned on when the switch is closed and is turned off when the switch is opened, whereby when fluid flows through the inlet the first magnet is moved toward the second magnet and the second magnet is magnetically repulsed to close the electrical switch and when fluid is not flowing through the inlet the electrical switch is open.

4. The pressure washer of claim 3 including a spring in the switch passage which is engageable with the first magnet when the first magnet moves away from the second magnet.

5. The pressure washer of claim 3 in which the first magnet is mounted on a piston which is slidably positioned in the switch passage.

6. A pressure washer comprising;

a fluid pump hosing having an inlet and an outlet, a pumping piston movably mounted in the housing for pumping fluid from the inlet to the outlet, a motor for driving the pumping piston, a nozzle connected to the outlet and including a valve for opening and closing the nozzle, a flow switch on the pump housing which automatically shuts off the motor when fluid is not flowing into the inlet, and means for relieving excess outlet pressure when the nozzle is closed, the pump housing including a switch passage which communicates with the inlet, and the flow switch including a first magnet movably mounted in the switch passage, a second magnet movably mounted on the pump housing outside of the switch passage, and an electrical switch mounted adjacent the second magnet and having a contact element which is engageable by the second magnet to close the electrical switch, whereby when fluid flows through the inlet the first magnet is moved toward the second magnet and the second magnet is magnetically repulsed to close the electrical switch and when the fluid is not flowing through the inlet the electrical switch is open, said pressure washer further including an inlet fitting which is secured to the pump housing and which is provided with an internal bore and a spring positioned in the internal bore and extending toward the first magnet, the first magnet being engageable with the spring when the first magnet moves away from the second magnet.

7. A pressure washer comprising;

a fluid pump housing having an inlet and an outlet, a pumping piston movably mounted in the housing for pumping fluid from the inlet to the outlet, a motor for driving the pumping piston, a nozzle connected to the outlet and including a valve for opening and closing the nozzle, a flow switch on the pump housing which automatically shuts off the motor when fluid is not flowing into the inlet, and means for relieving excess outlet pressure when the nozzle is closed, the pump housing including a switch passage which communicates with the inlet, and the flow switch including a first magnet movably mounted in the switch passage, a Second magnet movably mounted on the pump housing outside of the switch passage, and an electrical switch mounted adjacent the second magnet and having a contact element which is engageable by the second magnet to close the electrical switch, whereby when fluid flows through the inlet the first magnet is moved toward the second magnet and the second magnet is magnetically repulsed to close the electrical switch and when the fluid is not flowing through the inlet the electrical switch is open, the pressure relieving means including a bypass passage in the pump housing extending from the outlet to the inlet, valve means in the bypass passage for closing the bypass passage until the fluid pressure at the outlet exceeds a predetermined value, and a switch-actuating passage which extends from the bypass passage to the switch passage whereby fluid flowing through the bypass passage flows into the switch-actuating passage and moves the first magnet away from the second magnet, thereby opening the electrical switch.

8. The pressure washer of claim 7 in which the bypass passage includes a small diameter portion between the switch-actuating passage and the inlet which has a diameter smaller than the diameter of the switch-actuating passage.

9. A pressure washer comprising;

a fluid pump hosing having an inlet and an outlet, a pumping piston movably mounted in the housing for pumping fluid from the inlet to the outlet, a motor for driving the pumping piston, a nozzle connected to the outlet and including a valve for opening and closing the nozzle, a flow switch on the pump housing which automatically shuts off the motor when fluid is not flowing into the inlet, and means for relieving excess outlet pressure when the nozzle is closed, the motor including means for reciprocating the piston, a soap pump mounted adjacent the reciprocating means and including a soap pump housing and a soap pump piston reciprocably mounted in the soap pump housing, the soap pump piston being engageable by the reciprocating means for reciprocating the soap pump piston, the soap pump housing having a soap inlet and a soap inlet, and means for delivering soap from the soap outlet to the inlet of the fluid pump housing.

10. The pressure washer of claim 9 including check valve means at the soap inlet and the soap outlet for opening and closing the soap inlet and soap outlet as the soap piston reciprocates.

11. The pressure washer of claim 9 in which the soap pump housing is provided with a bleed opening.

12. The pressure washer of claim 11 in which the bleed opening is smaller than the soap inlet and the soap outlet.

13. A pressure washer comprising:

a pump housing having an inlet adapted to be connected to a source of fluid, an outlet, a pumping chamber, a pump motor, a first inlet passage extending from the inlet, a second inlet passage extending from the first inlet passage to the pumping chamber, an outlet passage extending from the pumping chamber to the outlet, and a bypass passage extending from the outlet passage to the second inlet passage, a first magnet movably mounted in the first inlet passage, a second magnet movably mounted on the pump housing outside of the first inlet passage, an electrical switch mounted adjacent the second magnet and having a contact element which is engageable by the second magnet to close the switch and is disengageable from the second magnet to open the switch, the electrical switch being connected to the pump motor which is turned on when the switch is closed and is turned off when the switch is opened, and a bypass valve mounted in the bypass passage for closing the bypass passage until the fluid pressure in the outlet passage exceeds a predetermined value.

14. The pressure washer of claim 13 in which said valve means in the bypass passage comprises a two-stage poppet valve having a first small-diameter stage which is engageable with a valve seat in the bypass passage and a second large-diameter stage whereby greater fluid pressure is required to move the poppet valve from a closed position to an open position than is required to maintain the poppet valve in an open position.

15. The pressure washer of claim 13 in which the first inlet passage includes an end wall which is engageable by the first magnet when fluid is flowing through the first inlet passage, the bypass passage including a large-diameter portion which extends from the outlet passage, a small-diameter portion which extends from the large diameter portion to the second inlet passage and a switch-actuating passage which extends from the large-diameter portion to the first inlet passage adjacent said end wall, the diameter of the switch-actuating passage being greater than the diameter of the small-diameter portion of the bypass passage whereby when the bypass valve opens fluid pressure in the bypass passage and the switch-actuating passage moves the first magnet away from the second magnet and the switch opens.

16. The pressure washer of claim 13 including a spring in the first inlet passage which is engageable with the first magnet when the first magnet moves away from the second magnet.

17. In a pressure washer having: a fluid pump housing having an inlet and an outlet, a pumping piston reciprocably mounted in the housing for pumping fluid from the inlet to the outlet, means for reciprocating the piston, the improvement comprising:

a soap pump mounted adjacent the reciprocating means and including a soap pump housing and a soap pump piston reciprocably mounted in the soap pump housing, the soap pump piston being engageable by the reciprocating means for reciprocating the soap pump piston, the soap pump housing having a soap inlet and a soap outlet, and means for delivering soap from the soap outlet to the inlet of the fluid pump housing.

18. The pressure washer of claim 17 including check valve means at the soap inlet and the soap outlet for opening and closing the soap inlet and soap outlet as the soap piston reciprocates.

19. The pressure washer of claim 17 in which the soap pump housing is provided with a bleed opening.

20. The pressure washer of claim 19 in which the bleed opening is smaller than the soap inlet and the soap outlet.

* * * * *

UNITED STATES PATENT AND TRADEMARK OFFICE

CERTIFICATE OF CORRECTION

PATENT NO. : 5,529,460

DATED : June 25, 1996

INVENTOR(S) : John A. Eihusen et al

It is certified that error appears in the above-indentified patent and that said Letters Patent is hereby corrected as shown below:

Col. 9, line 64 change "hosing" to — housing—.

Col. 10, line 32 change "hosing" to —housing—.

Col. 11, line 35 change "hosing" to —housing—.

Signed and Sealed this

Twenty-fourth Day of September, 1996

*Attest:*

Bruce Lehman

BRUCE LEHMAN

*Attesting Officer*

*Commissioner of Patents and Trademarks*